United States Patent [19]

Barasch

[11] 4,094,504

[45] June 13, 1978

[54] SIGNALLING DEVICE TO BE USED WITH A SPORT IMPLEMENT FOR DETECTING AND INDICATING THE PROPER OR IMPROPER USE THEREOF

[76] Inventor: Kenneth S. Barasch, 380 Lenox Ave., South Orange, N.J. 07079

[21] Appl. No.: 663,623

[22] Filed: Mar. 3, 1976

[51] Int. Cl.[2] ..... A63B 69/38

[52] U.S. Cl. ..... 273/29 A; 46/52; 273/183 D; 273/162 R; 273/186 A

[58] Field of Search ..... 273/29 A, 35 R, 183 R, 273/183 D, 186 R, 186 A, 73 K, 26 R, 26 B, 162 R; 46/52, 53

[56] References Cited

U.S. PATENT DOCUMENTS

| | | | |
|---|---|---|---|
| 1,417,019 | 5/1922 | Bartolowsky | 46/52 |
| 1,519,052 | 12/1924 | Reach | 273/186 A |
| 1,549,350 | 8/1925 | Deik | 273/186 A |
| 2,780,098 | 2/1957 | Maroth | 273/29 A |
| 3,730,530 | 5/1973 | Oka | 273/186 A |

FOREIGN PATENT DOCUMENTS

| | | | |
|---|---|---|---|
| 615,576 | 2/1961 | Canada | 273/183 D |
| 254,276 | 4/1948 | Switzerland | 46/52 |

*Primary Examiner*—Richard C. Pinkham
*Assistant Examiner*—T. Brown
*Attorney, Agent, or Firm*—Oblon, Fisher, Spivak, McClelland & Maier

[57] ABSTRACT

A signalling device to be used with a sport implement, such as, for example, a tennis racquet or golf club, for detecting and indicating the proper use thereof, includes a plurality of mechanical reed members, the longitudinal axes of which are disposed with respect to the tennis racquet or golf club structure as to be aligned with the stroke direction when a proper stroke is performed whereby the signalling device will emit a well-defined audible signal indicating the performance of a proper stroke. The reed members may be disposed within a housing which may, in turn, be mounted upon the racquet frame or club shaft, or alternatively, may be integrally disposed within the frame or shaft, the latter structures serving as the housings thereof. Still further, and alternatively, in lieu of the reed members being aligned with the stroke direction, that is, the same are, within such embodiment, disposed perpendicular to the plane of the tennis racquet or golf club face, the reed members may likewise be disposed parallel to the plane of the racquet or club face and perpendicular to the longitudinal axis of the implement whereupon, instead of such members emitting a signal when a proper stroke is performed, such members emit an audible signal when an improper stroke is performed.

2 Claims, 9 Drawing Figures

SIGNALLING DEVICE TO BE USED WITH A SPORT IMPLEMENT FOR DETECTING AND INDICATING THE PROPER OR IMPROPER USE THEREOF

BACKGROUND OF THE INVENTION

1. Field of the Invention

The present invention relates generally to signalling devices, and more particularly to an improved signalling device which may be operatively connected to a sport implement so as to audibly indicate the fact that the user is or is not using the implement in the properly intended manner.

2. Description of the Prior Art

In many sports, such as, for example, tennis and golf with which the present invention is particularly adaptable, proper technique of the physical skills is extremely important in order to play the game correctly and therefore successfully. Within the particularly noted sports, the swing of the tennis racquet or the golf club is probably the most important part of the player's game due to the fact that all facets of such sports are intimately related solely to such physical skill as opposed to other sports, such as, for example, baseball, wherein other skills are equally important, such as, for example, baserunning, defensive fielding, throwing, and the like, which are skills entirely different from offensive batting. In summary, as offensive play within golf, and both defensive and offensive play within tennis, involve and inherently depend upon the proper swing of the tennis racquet or golf club, the development of such physical skill will have the most bearing upon the player's ability.

Although there are many theories as to how to achieve, or what constitutes, a correct and effective swing within the noted sports, it is generally accepted that the player should be professionally instructed with respect to the same whereby the player may initially learn what does constitute a generally accepted proper and effective swing. However, in order to in fact achieve such a swing, that is, in order to develop the same whereby such will become an intimate part of the player's game, the player must practice the same, particularly under suitable conditions. Such suitable or ideal conditions may of course be realized during an instruction period wherein the player is constantly under the strict supervision of the professional instructor, however, due to the expense and availability of such instruction, the player cannot be under professional supervision at all times. Still further, even when the player is in fact being instructed by means of a professional instructor, the latter person cannot always determine or detect the precise defect in the improper swing.

Consequently, for those periods of time during which professional instruction and supervision is, for one reason or another, not being utilized, there is a substantial need for a training device which is capable of detecting or indicating a proper or an improper swing of the sport implement. Concomitantly therewith, there exists a need for such a device which may in fact be utilized by means of a professional instructor as an instruction or training aid.

SUMMARY OF THE INVENTION

Accordingly, it is an object of the present invention to provide a new and improved signalling device.

Another object of the present invention is to provide a new and improved signalling device which is capable of being operatively connected to a sport implement.

Still another object of the present invention is to provide a new and improved signalling device which is capable of being operatively connected to a sport implement for detecting, and indicating to the user, a proper and/or an improper use of the implement so as to facilitate the proper use of the implement by the sport player without the necessity of being professionally observed.

Yet another object of the present invention is to provide a new and improved signalling device which is capable of being operatively connected to a sport implement so as to be used as a training device for the development of skills within various sport activities without requiring the presence of a professional instructor.

Yet still another object of the present invention is to provide a new and improved signalling device which is capable of being operatively connected to a sport implement so as to be used by a professional instructor in order to aid such person in the instruction of and detection of faults in the swing of the tennis or golf players.

A further object of the present invention is to provide a new and improved signalling device which is readily capable of being operatively connected to a sport implement in an easy and simple manner.

A still further object of the present invention is to provide a new and improved signalling device which is readily capable of being integrally incorporated within a sport implement.

A yet further object of the present invention is to provide a new and improved signalling device which is small, portable, and readily transportable.

A still yet further object of the present invention is to provide a new and improved signalling device which is relatively inexpensive to manufacture and may be manufactured in large quantities.

The foregoing and other objectives are achieved in accordance with the present invention wherein there is provided a signalling device which is adapted to be operatively associated with a sport implement, such as, for example, a tennis racquet or golf club, and which comprises a plurality of mechanical reed members, the longitudinal axes of which are disposed with respect to the tennis racquet or golf club structure so as to be aligned with the stroke direction when a proper stroke is performed whereby the signalling device will emit a well-defined audible signal indicating the performance of a proper stroke. The reed members may be disposed within a housing which may, in turn, be mounted upon the racquet frame or club shaft, or alternatively, may be integrally disposed within the frame or shaft, the latter structures serving as the housings therefor. Still further, and alternatively, in lieu of the reed members being aligned with the stroke direction, that is, the same are, within such embodiment, disposed perpendicular to the plane of the tennis racquet or golf club face, the reed members may likewise be disposed parallel to the plane of the racquet or club face and perpendicular to the longitudinal axis of the implement whereupon, instead of such members emitting a signal when a proper stroke is performed, such members emit an audible signal when an improper stroke is performed.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts throughout the several views, and wherein.

DETAILED DESCRIPTION OF THE ILLUSTRATED EMBODIMENTS

Figure 1:
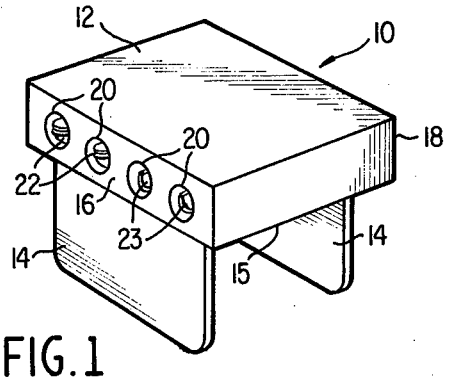
FIG. 1 is a perspective view of the signalling device constructed in accordance with the present invention and showing its cooperative parts.
Figure 2:
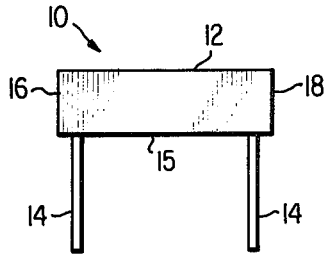
FIG. 2 is a side elevation view of the device of FIG. 1.

Referring now to the drawings, and more particularly to FIGS. 1 and 2 thereof, the signalling device of the present invention is generally indicated by the reference character 10 and is seen to include a housing 12, which has the configuration of a rectangular solid, and two rectangular platetype legs 14 which depend from the bottom or base surface 15 thereof. The width of legs 14 is seen to be slightly less than that of housing 12, as best seen within FIG. 1, and as best seen within FIG. 2, the legs 14 are also secured to the bottom or base surface of housing 12 at positions disposed inwardly of the front and rear faces 16 and 18, respectively, thereof.

A plurality of bores 20, such as, for example, four, are provided within housing 12 so as to extend from front face 16 to rear face 18 and thereby define apertures therewithin, and two pairs of mechanical reeds 22 and 23 are respectively disposed within the bores 20, by means of, for example, a friction fitting.

Figure 3:
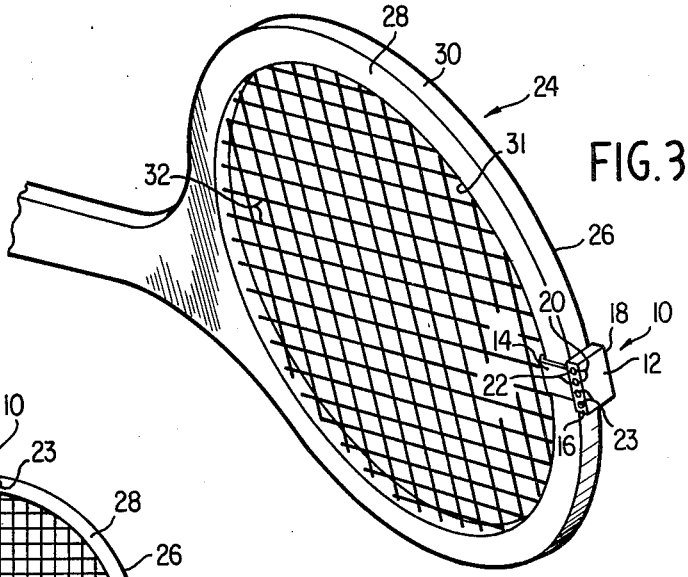
FIG. 3 is a perspective view of the device of FIG. 1 operatively mounted upon the frame of a tennis racquet.

As can best be appreciated from FIG. 3, in accordance with a first embodiment of a present invention, the signal device 10 of FIGS. 1 and 2 is adapted to be mounted upon a tennis racquet, generally indicated by the reference character 24, so as to detect and indicate a proper swing thereof by means of the tennis player when using the same. More particularly, as a conventional tennis racquet 24 has a frame member 26 which has a substantially rectangular configuration in cross-section, the area defined between the bottom surface 15 of housing 12 and the interior surfaces of legs 14 is such as to provide a proper mating of the device 10 with the frame 26 when mounted thereon.

Legs 14 are spaced apart a predetermined distance which corresponds to the thickness of the racquet frame member 26 and in this manner the device 10 may be simply mounted upon the frame member 26, as seen within FIG. 3, by means of a friction fitting, leg members 14 being in friction contact with the side surfaces 28 of frame member 26 while the bottom surface 15 of housing 12 is seated upon the top surface 30 of the frame member 26, it being appreciated however, that the depth or height of legs 14 is such that they do not project downwardly below the bottom edge portions 31 of side surfaces 28 so as not to obstruct any portion of the racquet strings 32.

Alternatively, however, in order to insure the fixation of the device 10 upon the racquet 24, and more particularly upon the frame member 26 thereof, the depth or height of legs 14 may be such as to project downwardly below the bottom edge portions 31 of side surfaces 28, whereupon the device 10 having been mounted upon the racquet frame 26, the bottom portions of the legs 14 may be crimped inwardly about the bottom edges 31 of the frame 26. In this manner, due to the inwardly crimped portions of the legs 14, the device 10 cannot become disengaged from the frame member 26, even as a result of successive shocks imparted thereto as a result of contact between the racquet 24 and the tennis ball, not shown, during operative periods, and furthermore, due to the rectangular configuration of frame member 26, and a similar configuration effectively imparted to the device 10 as defined by the legs 14 and the bottom surface 15 of housing 12, the device 10 is likewise prevented from rotating upon frame member 26 even under operative conditions.

As will also be noted from FIGS. 1 and 3, the first pair of reed members 22 are disposed so as to face forwardly, while the second pair of reed members 23 are disposed so as to face rearwardly. In this manner, the signalling device 10 is peculiarly adaptable for use in the sport of tennis, for as the user swings the racquet 24 during, for example, a forehand stroke, reeds 22 will be so disposed as to emit an audible signal if the stroke is properly performed, while during, for example, a backhand stroke, reeds 23 will be so disposed as to emit an audible signal if such stroke is likewise properly performed.

It will be additionally noted that the device 10 is mounted upon frame member 26 such that the bottom planar surface 15 of hosing 12 is in contact with the upper planar surface 30 throughout the entire width thereof, bores 20, as well as reed members 22 and 23 disposed therein, will be disposed parallel to surface 30 of the frame member 26 and perpendicular to the plane formed by the racquet strings 32. As the operation of mechanical reeds is well-known in that the same will emit a well-defined audible signal only when air passes therethrough in a direction substantially parallel with the longitudinal axes thereof, it will be appreciated that the reeds 22 or 23 will in fact emit such a well-defined audible signal only when the axes thereof are disposed parallel to the direction of the tennis stroke, or in other words, when the plane, within which the strings 32 are disposed, is perpendicular to the direction of the stroke, such thereby indicating the performance of a proper stroke. If, however, the tennis racquet is rotated about its longitudinal axis such that the reed members are in effect skewed with respect to the stroke direction, or, similarly, if the tennis racquet is tilted about an axis disposed transversely with respect to the longitudinal axes of the reed members, such that the axes of the reed members are again skewed with respect to the stroke direction, the audible signal will be altered indicating an improper stroke has been performed.

Figure 4:
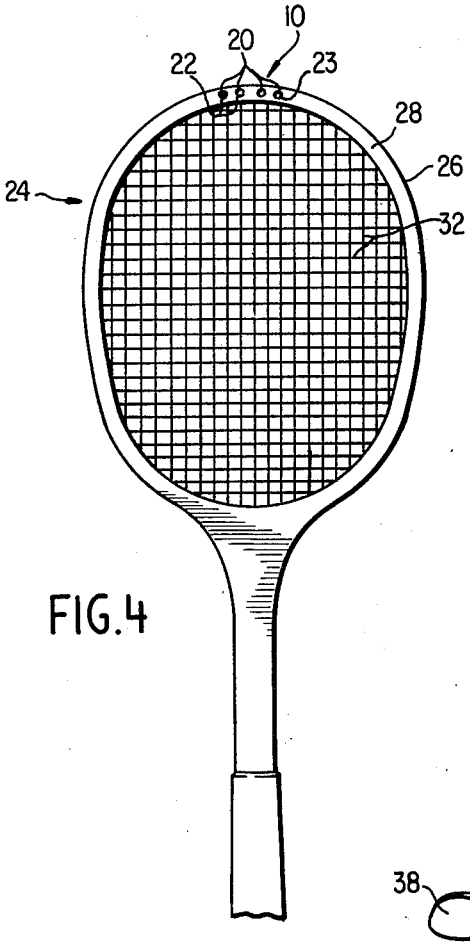
FIG. 4 is a front elevation view of the device of FIG. 1 integrally mounted within the frame of a tennis racquet.

Referring now to FIG. 4, another embodiment of the present invention is disclosed wherein the device 10 is integrally built into the tennis racquet 24, and more particularly, within the frame member 26 thereof. In accordance with this embodiment, bores 20 are formed within frame member 26, the latter serving as the housing therefor, and reed members 22 and 23 are disposed therewithin in a manner similar to that of the embodiment of FIGS. 1–3. In this manner, the device 10 need not be mounted upon or removed from the tennis racquet 24 and the device is always readily available to the tennis player for aiding the player in perfecting his stroke.

Figure 5:
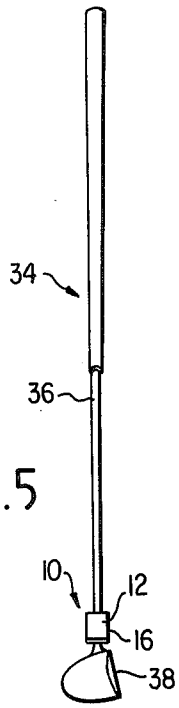
FIG. 5 is a side elevation view of the device of FIG. 1 operatively mounted upon a golf club.

Still further, as shown within FIG. 5, the device 10 is equally applicable to use in conjunction with a golf club, generally indicated by the reference character 34, whereby, in accordance with this embodiment, the device 10 may be mounted upon the club shaft 36 in a manner similar to the mounting thereof upon the tennis racquet frame 26 as disclosed within FIG. 3, the disposition of the reed members within the device 10 being such that the longitudinal axes thereof are disposed parallel with the stroke direction when the club face 38 is properly disposed with respect to the stroke direction.

In this manner, if the aforenoted disposition of the device 10 and the club face 38 is maintained with respect to the golf club stroke direction, the reeds 22 will in fact emit a well-defined audible signal indicative of the performance of a proper stroke. If, however, the club is rotated about the longitudinal axis thereof such that the longitudinal axes of the reeds 22 are no longer disposed parallel with the stroke direction and are in fact skewed with respect thereto, or, similarly, if the club is tilted about an axis disposed perpendicular to the plane within which the bores 20 and reed members 22 and 23 are defined, such that the longitudinal axes of the reed members are again skewed with respect to the stroke direction, the audible signal will be altered indicating an improper stroke has been performed.

Figure 6:
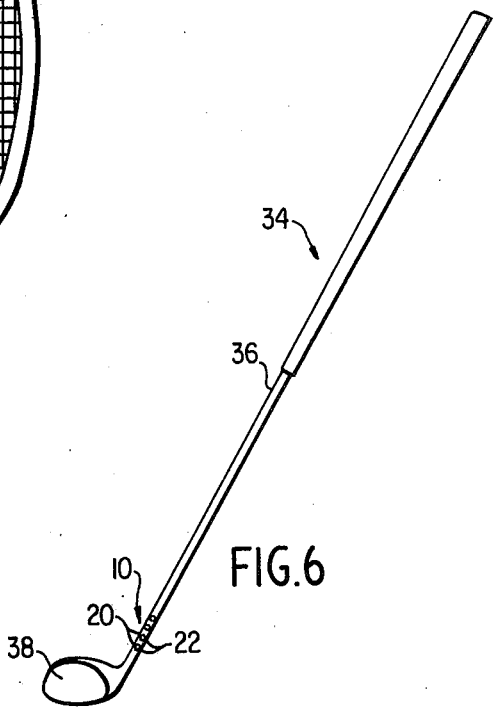
FIG. 6 is a front elevation view of the device of FIG. 1 integrally mounted within the shaft of a golf club.

With reference now being made to FIG. 6, still another embodiment of the present invention is disclosed wherein it is seen that this embodiment is quite similar to that of FIG. 4, wherein the signalling device 10 of the present invention has been integrally incorporated within the golf club shaft 36. It will be noted, however, that with respect to the sport of golf, as only the forward stroke and follow-through are important, the reed members of the embodiments of FIGS. 5 and 6 are all disposed so as to face forward.

Figure 7:
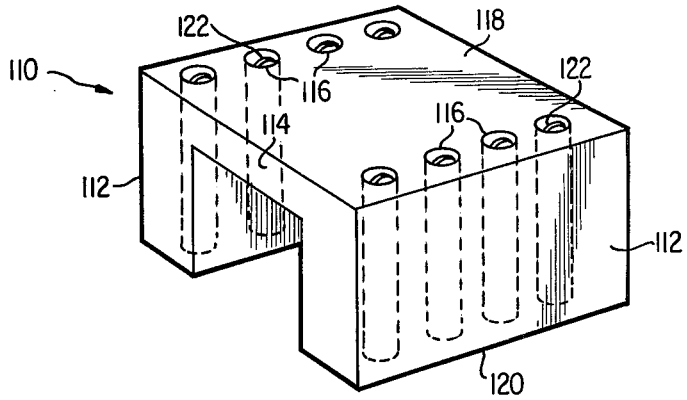
FIG. 7 is a view similar to that of FIG. 1, showing however an alternative embodiment of the signalling device of the present invention.

With particular reference now being made to FIG. 7, an alternative embodiment of the signalling device of the present invention is disclosed therein and is generally indicated by the reference character 110. As will be apparent, such device is somewhat similar to the device 10 of FIG. 1 in that the same is substantially U-shaped in cross-section so as to be able to be mounted upon the tennis racquet frame, however the device 110 is substantially different from the device 10 in that the leg members 112 form rectangular solids and are interconnected at the upper portions thereof by means of a substantially flat plate member 114.

A plurality of through-bores 116 are formed within leg members 112 so as to extend from the upper external surface 118 thereof to the lower external surface 120 thereof, and two pairs of mechanical reed members 122 are disposed within the bores 116 by means of, for example, a friction fitting, the reeds being arranged such that one pair thereof is disposed in a first direction while the other pair thereof is disposed in an opposite direction.

Figure 8:
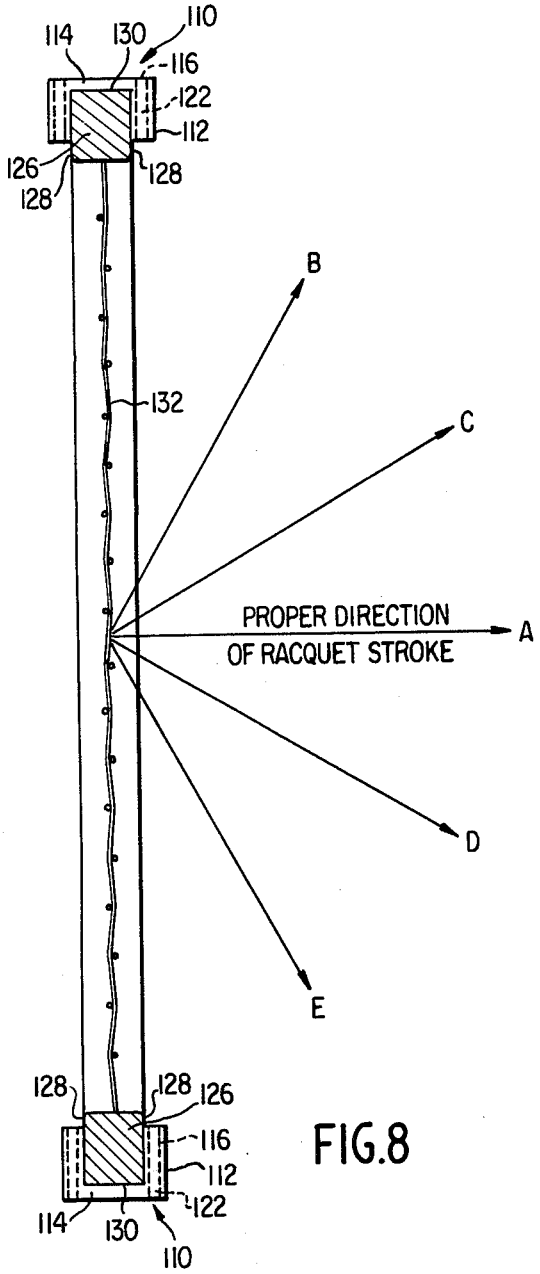
FIG. 8 is a transverse cross-sectional view, of a tennis racquet having incorporated thereon a plurality of the devices of FIG. 7, taken along a plane perpendicular to the longitudinal axis of the racquet.

As will be appreciated from the preceding embodiments, a plurality of the devices 110 may be secured, by means of, for example, a friction or snap fitting, to a tennis racquet, generally indicated by the reference character 124, and more particularly to the frame member 126 thereof, as best seen in FIG. 8. It is apparent that the interior surfaces of leg members 112 tightly engage the front and rear faces 128 of the frame member 126 while the interior surface of member 114 similarly engages the outer surface 130 of frame member 126.

In this manner, the reeds 122 are disposed parallel to the plane of the tennis racquet, and more particularly the plane thereof within which the strings 132 are disposed, and are also disposed upon the side portions of the frame member 126 such that the reeds are disposed substantially perpendicular to the longitudinal axis of the racquet. As will therefore be appreciated, during use of the implement, if a proper stroke is performed by the player, such as that represented by arrow A within FIG. 8, as the reed members will be disposed perpendicular to such direction, there is no forced air component passing through the reed members and consequently the same do not emit an audible signal. However, if an improper stroke is performed by the player, such as, for example, any one of those exemplarily shown by arrows B-E of FIG. 8 which occurs when the racquet is rotated about the longitudinal axis thereof, a forced air component will pass through the reed members and an audible signal will be emitted thereby indicating the performance of an improper stroke.

Figure 9:
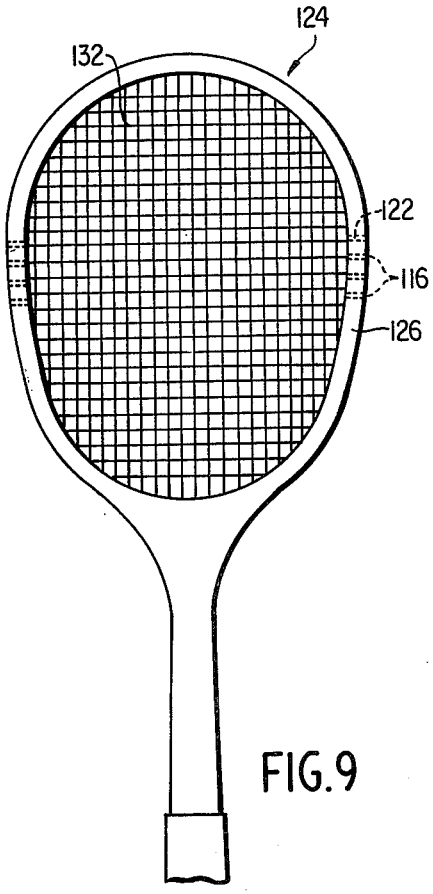
FIG. 9 is a view similar to that of FIG. 4 wherein the devices of FIG. 7 have been integrally incorporated within a tennis racquet.

Referring now to FIG. 9, there is shown another embodiment of the present invention wherein the reed members 122 may be housed within bores 116 which are formed within the tennis racquet frame member 126 in a manner similar to the embodiment of FIG. 4. The bores 116 and reed members 122 are again disposed parallel to the plane of the racquet strings 132 and perpendicular to the longitudinal axis of the implement 124, and in this manner, the implement may always be provided with the signalling device of the present invention.

Obviously, many modifications and variations of the present invention are possible in light of the above teachings. It is to be understood therefore that within the scope of the appended claims, the present invention may be practiced otherwise than as specifically described herein.

What is claimed as new and desired to be secured by letters patent of the U.S. is:

1. A signalling device in combination with a tennis racquet for detecting and indicating the proper or improper use thereof, comprising:

air-actuable means comprising a plurality of reed members, each said reed member having a longitudinal axis, for emitting an audible signal when air passes through said means in a predetermined manner;

some of said reed members being mounted on said tennis racquet in a first direction so as to indicate a proper forehand stroke of said tennis racquet and other ones of said reed members being mounted on said tennis racquet in a direction opposite said first direction so as to indicate a proper backhand stroke of said tennis racquet; said proper stroke being indicated by said reed members when said longitudinal axis is moved parallel to the direction of said forehand and backhand stroke of said tennis racquet; and means mounting said reed members to said tennis racquet.

2. A signalling device as set forth in claim 1, wherein said mounting means comprises:

bores within said tennis racquet within which said air actuatable reed members are disposed.

* * * * *